US006230915B1

(12) United States Patent
Liu

(10) Patent No.: US 6,230,915 B1
(45) Date of Patent: May 15, 2001

(54) RATTAN BASKET

(75) Inventor: Hsin Ying Liu, Taipei (TW)

(73) Assignee: Pro-Winnex Worldwide Corp., Taipei (TW)

( * ) Notice: Subject to any disclaimer, the term of this patent is extended or adjusted under 35 U.S.C. 154(b) by 0 days.

(21) Appl. No.: 09/428,475

(22) Filed: Oct. 28, 1999

(51) Int. Cl.[7] ..... B65D 6/18

(52) U.S. Cl. ..... 220/6; 220/4.29; 220/4.33; 217/122

(58) Field of Search ..... 220/4.28, 4.29, 220/4.33, 6, 7, 668; 217/122

(56) References Cited

U.S. PATENT DOCUMENTS 3,958,713 * 5/1976 Selz ..... 220/6
4,053,079 * 10/1977 Karpisek ..... 217/43 A
4,662,532 * 5/1987 Anderson et al. ..... 220/7
5,072,828 * 12/1991 Irvine ..... 220/4.33
5,282,542 * 2/1994 Mo ..... 220/7
5,595,305 * 1/1997 Hart ..... 206/600
5,918,743 * 7/1999 Uitz ..... 206/509
5,931,326 * 8/1999 Weng ..... 220/4.33

FOREIGN PATENT DOCUMENTS

2262503A * 6/1993 (GB) ..... 220/4.29

* cited by examiner

*Primary Examiner*—Stephen Castellano
(74) *Attorney, Agent, or Firm*—Dougherty & Troxell

(57) ABSTRACT

A rattan basket is disclosed. The rattan basket has a first, a second, a third and a fourth plans incorporated into a rectangle frame. The rattan basket further has a bottom plan and a cover. With the insertion of a first connector, a second connector and a third connector, the rectangle frame and the bottom plan are securely connected together. With the insertion of the first connector, the second connector and a fourth connector, the cover is able to be pivotally connected to encase the basket.

2 Claims, 7 Drawing Sheets

RATTAN BASKET

BACKGROUND OF THE INVENTION

1. Field of the Invention

The present invention relates to a basket, and more particularly, to a rattan basket which is able to be assembled after delivery. The basket is woven piece by piece and then connected with one another by connectors, such that the space will be greatly reduced when stored and delivered.

2. Description of the Related Art

The reason for the popularity of rattan furniture is because the way it is woven such that the objects stored therein is not easy to have fungus. Normally, a piece of rattan furniture uses twigs or rods to form the main body and then strips of rattan are woven between the twigs to form a plan. Therefore, plans of rattan are connected with one another to gradually form the contour of a furniture. Although, this kind of weaving method do meet the requirements of various customers, most of the weaving process involves manual labor, which is troublesome and too time consuming. Furthermore, once the rattan furniture is finished, it requires a large space for storage and shipment. Accordingly, the cost is intentionally increased.

To solve such a problem, a new process of assembling rattan furniture is introduced to the market. This kind of rattan furniture uses iron rods as the main body of the furniture. Once the plan formed by strips of rattan is finished, retainers such as bolts or rivets are used to secure one plan with another. According to this kind of new formation, rattan furniture can be assembled after delivery and the cost for storage and shipment is greatly reduced because the furniture is able to be disassembled before being delivered to the customers. Again, this kind of assembly also requires a lot of labor to connect all the plans together. Other kinds of damage may also happen if the retainers used to connect the plans together are loose.

In order to obviate and mitigate the aforementioned problems, the present invention provides an improved rattan basket which is able to be disassembled when stored and shipped and the assembly of which is easy and simple, such that the rattan basket is economic labor efficient.

SUMMARY OF THE INVENTION

The main objective of the invention is to provide a rattan basket which is able to be disassembled for storage and shipment.

Another objective of the invention is that the each plan of the basket contains a main frame and a secondary frame. With such an arrangement, the plans of the basket are able to be easily connected together by retainers inserted in the secondary frames. When disassembly of the rattan basket is necessary, the user can just detach the retainers from the secondary frames of two adjacent plans, so that the basket is once again become isolated plans.

Still, another objective of the invention is to provide an improved rattan basket containing a cover. The cover is pivotally connected with the basket so as to achieve the purpose of covering the basket. The rattan basket uses a second retainer to pivotally connect the cover to one side of the rattan basket, such that the cover is able to pivot relative to the basket.

Other objective of the invention will be clear after the detailed description of the package with the reference of the accompanying drawings.

BRIEF DESCRIPTION OF THE INVENTION

The present invention will be better understood with the description to the following drawings, wherein.

DETAILED DESCRIPTION OF THE PREFERRED EMBODIMENT

Figure 1:
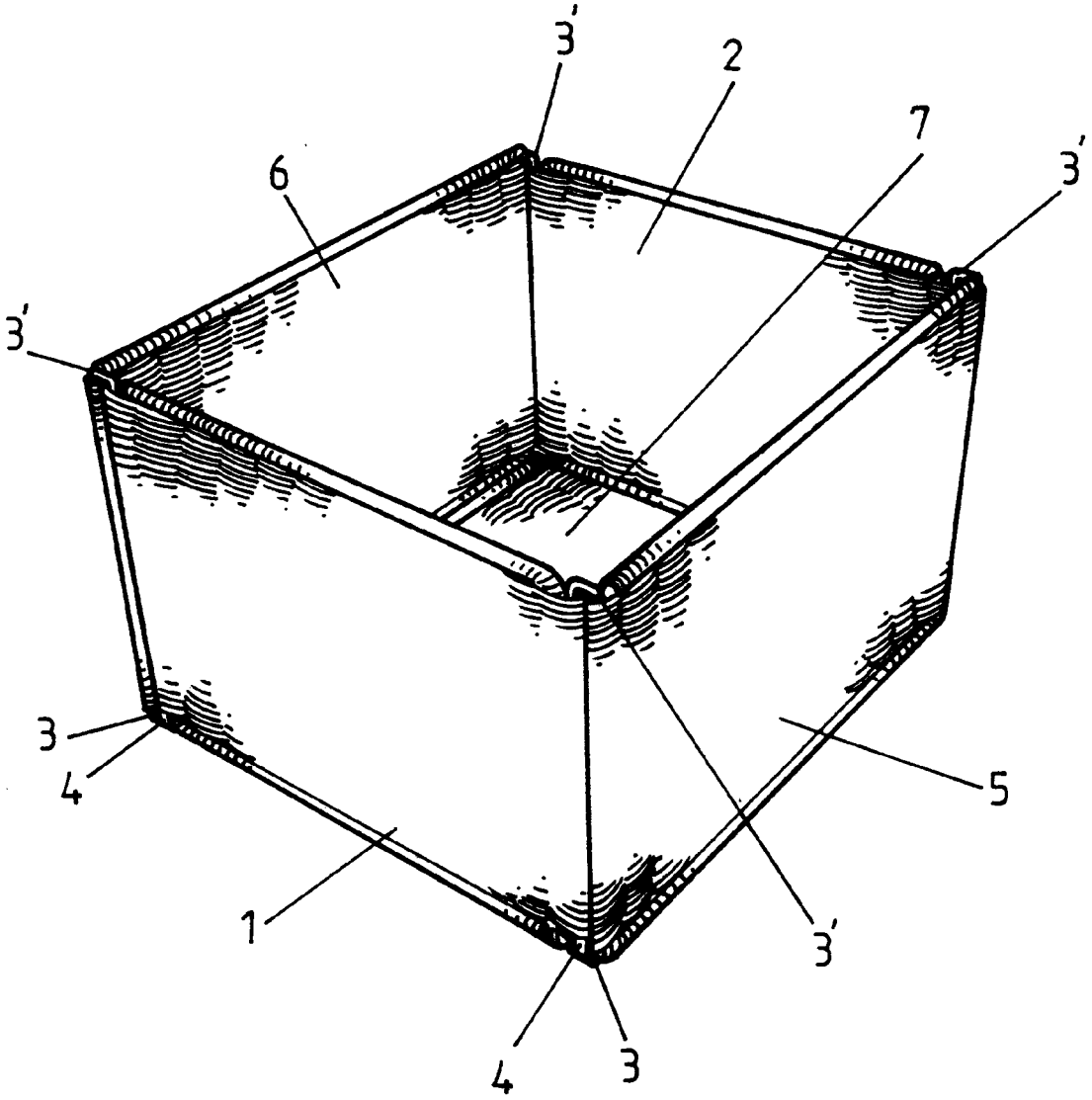
FIG. 1 is a perspective view showing the rattan basket constructed in accordance with the present invention.

With reference to FIG. 1, the rattan basket of the invention has a first plan (1), a second plan (2) opposite to the first plan (1), a third plan (5) engaged with edges of the first and the second plans (1,2), a fourth plan (6) engaged with edges of the first and the second plans (1,2) and opposite to the third plan (5) and a bottom plan (7) engaged with edges of the first, the second, the third and the fourth plans (1,2,5,6). Furthermore, a first connector (3) is provided to secure bottom edges of the first, the second, the third and the fourth plans (1,2,5,6).

Figure 2:
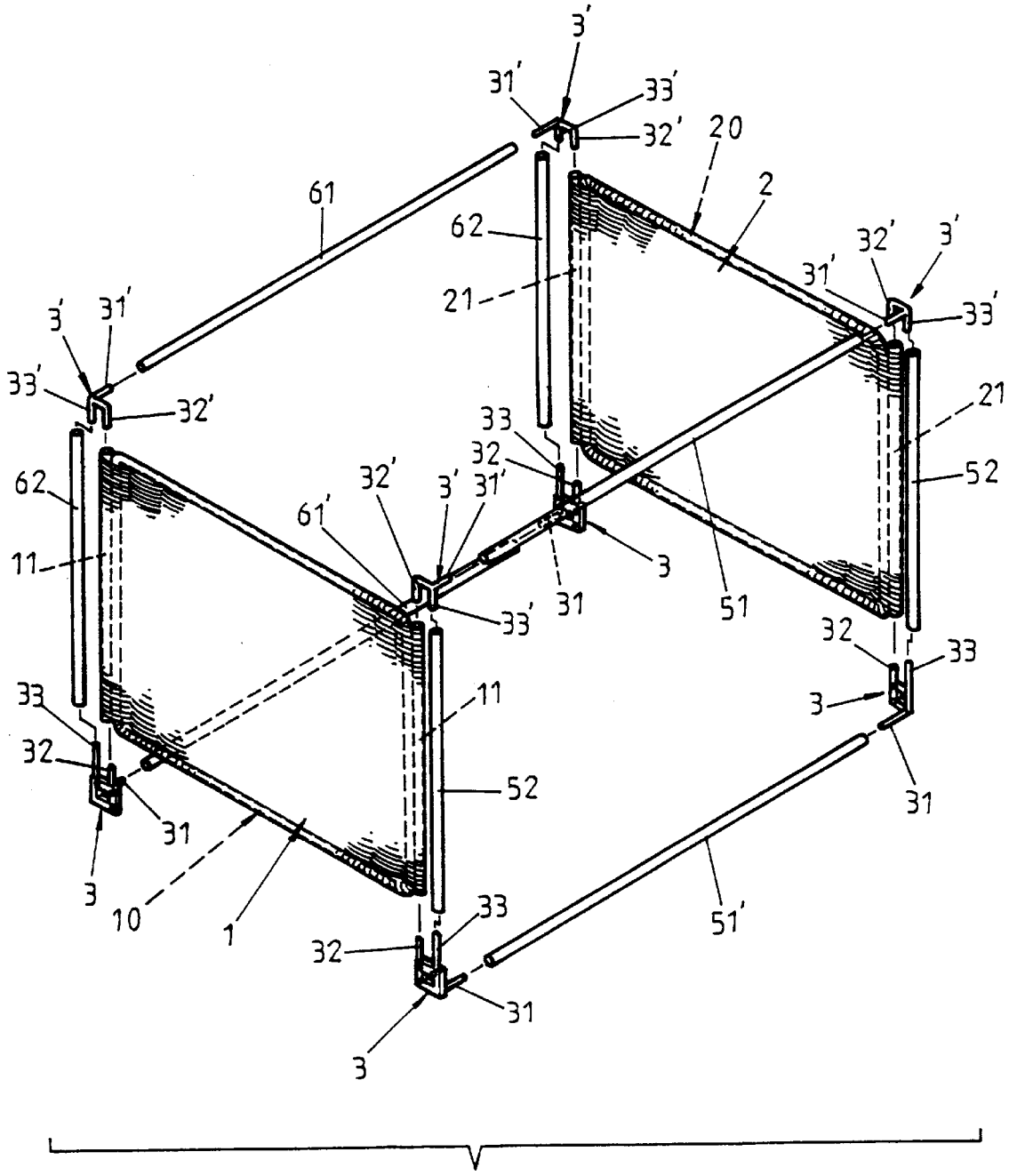
FIG. 2 is an exploded perspective view showing the components of the rattan basket shown in FIG. 1.

Referring to FIG. 2, it is to be noted that the first plan (1) has a rectangle main frame (10) and two side frames (11) each securely mounted on opposite sides of the main frame (10). The second plan (2) has a rectangle main frame (20) and two side frames (21) each securely mounted on opposite sides of the main frame (20). The third and the fourth plans (5,6) respectively have a first and a second spaced horizontal rails (51,51',61,61') and a pair of spaced vertical rails (52,62). For easier understanding and description, the rattan strips on the third and the fourth plans (5,6) are removed.

The side frames (11,21) of the first plan (1) and the second plan (2) are hollow and the first and the horizontal rails (51,51'61,61') are also hollow, such that a first connector (3) and a second connector (3') are able to connect the first, the second, the third and the fourth plans (1,2,5,6) together. As shown in FIG. 2, it is to be noted that the first connector (3) has a first extension (31) to be inserted into one ends of the horizontal rail (51',61'), a second extension (32) to be inserted into one ends of the side frames (11,21) of the first and the second plans (1,2) and a third extension (33) to be inserted into one ends of the vertical rails (52,62). After the extensions (31,32,33) of the first connector (3) are respectively inserted into the ends of the horizontal rails (51'61'), the side frames (11,21) and the vertical rails (52,62), one side of the rattan basket is assembled. Still referring to FIG. 2, it is to be noted that the second connector (3') has a first extension (31') to be inserted into the other end of the horizontal rails (51,61), a second extension (32') to be inserted into the other ends of the side frames (52,62) and a third extension (33') to be inserted into the other ends of the vertical rails (52,62). When the extensions (31',32'33') are inserted respectively into the horizontal rails (51,61), the side frames (52,62) and the vertical rails (52,62), the other side of the rattan basket of the invention is assembled as shown in FIG. 3.

Figure 4:
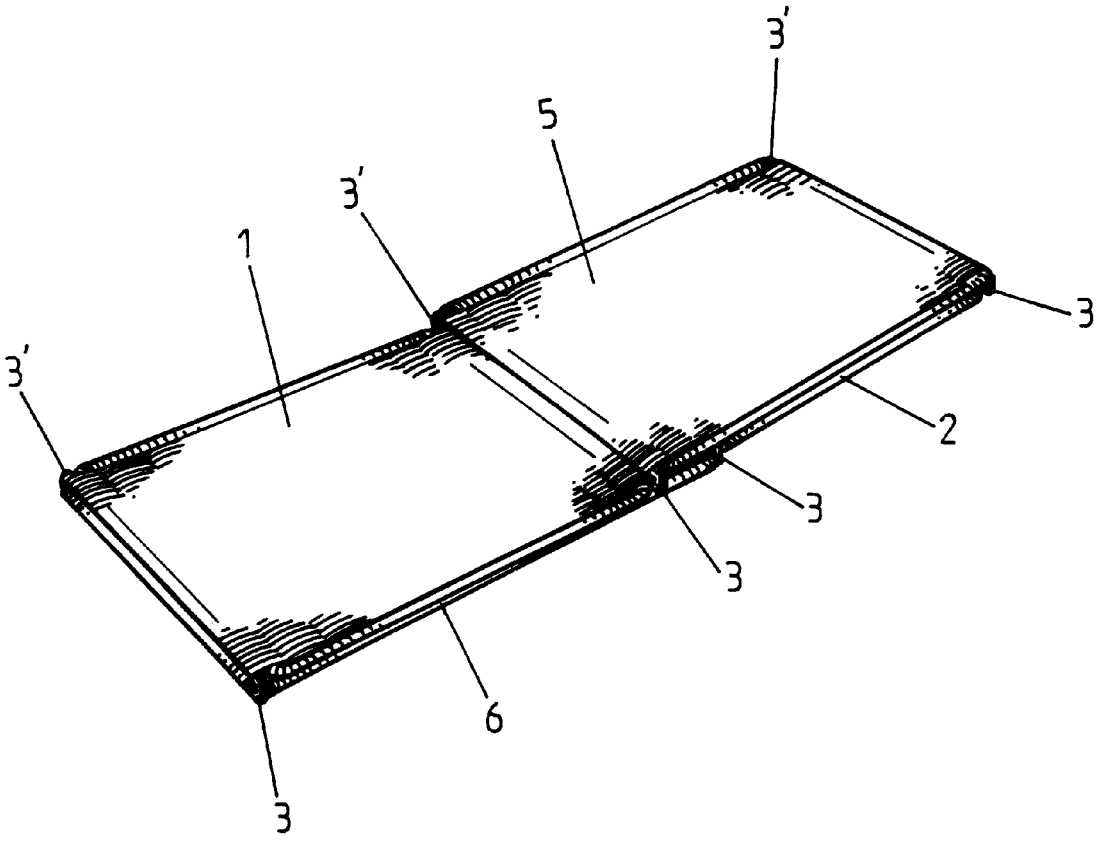
FIG. 4 is a perspective view of the folded rattan basket without the bottom plan.

Referring to FIG. 4, when the first, the second, the third and the fourth plans (1,2,5,6) are connected by the first connector (3), the connected plans (1,2,5,6) are able to be folded for storage or shipment so as to reduce the space occupied.

Figure 3:
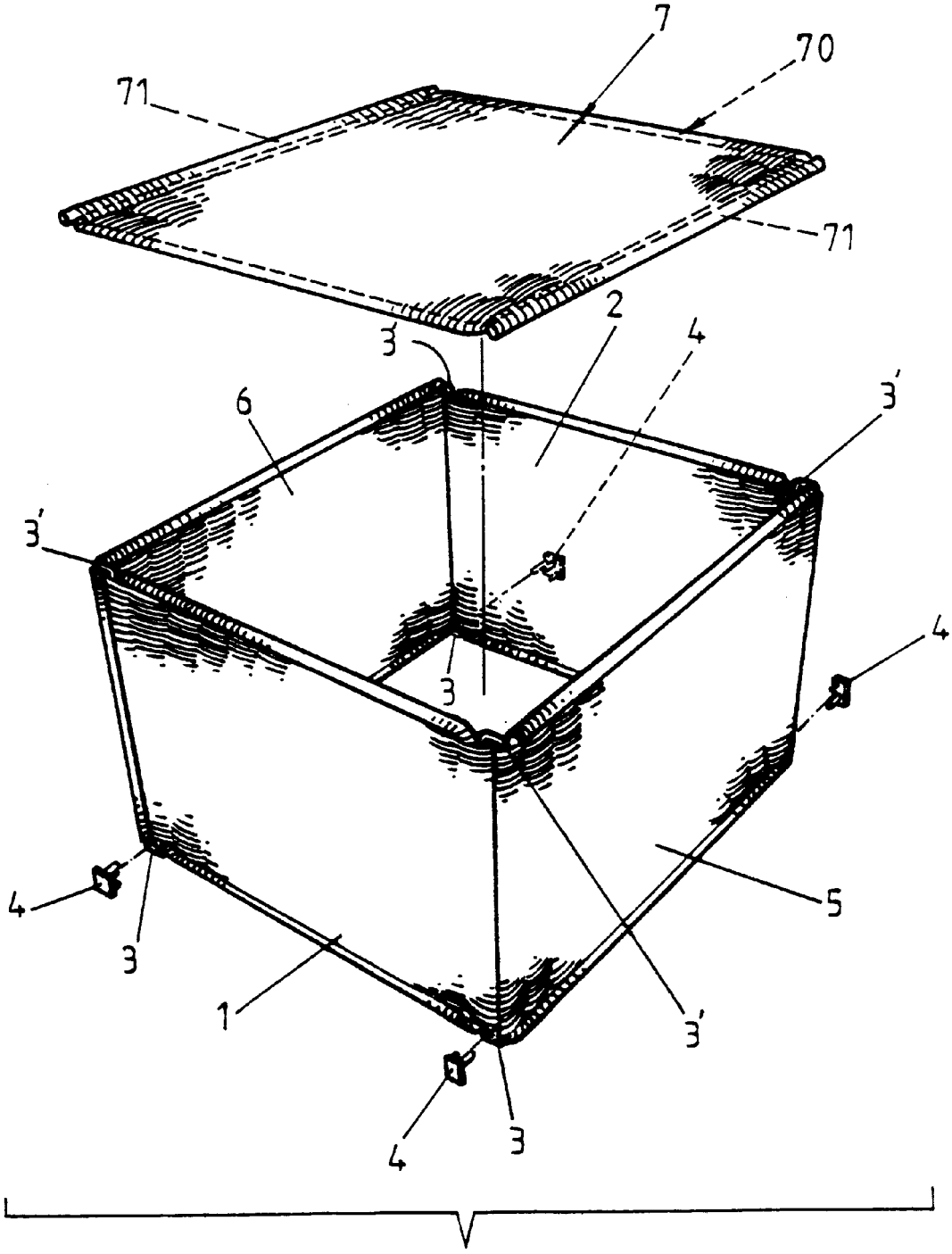
FIG. 3 is an exploded perspective view showing the bottom plan of the rattan basket of the invention.
Figure 5:
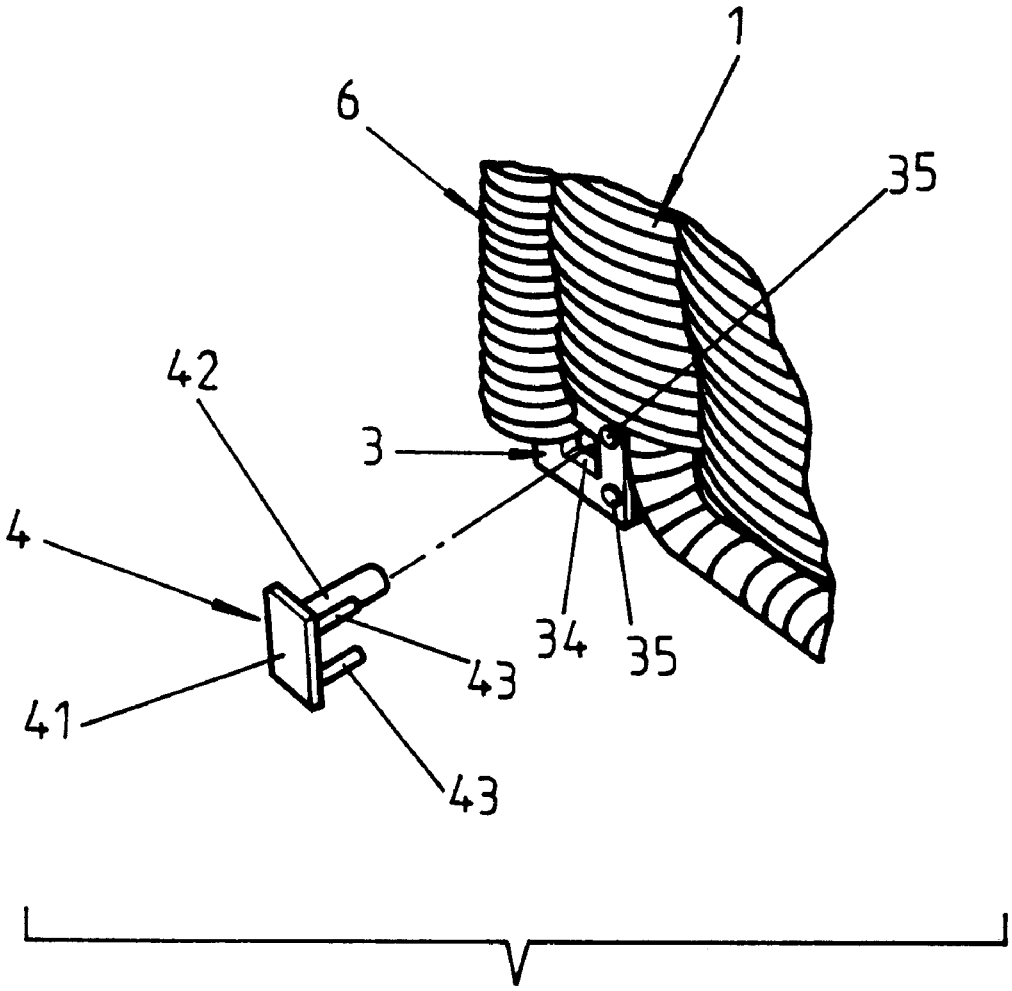
FIG. 5 is a partially enlarged perspective view showing a connector used to connect the bottom plan to the rattan basket of the invention.

Referring to FIG. 5 and taking FIG. 3 for reference, the first connector (3) further has a through hole (34) defined therethrough and two horizontal blind holes (35) defined therein. A third connector (4) has a base (41), a extension (42) formed to correspond to the through hole (34) and two horizontal rods (43) formed to correspond to the blind holes (35). Therefore, when a bottom plan (7) having two hollow side frames (71) respectively and oppositely mounted on a rectangle main frame (70) is to be engaged with edges of the first, the second, the third and the fourth plans (1,2,5,6), the two rods (43) are inserted into the blind holes (35) and the extension (42) is inserted through the through hole (34) and into one end of the hollow side frame (71), so that the bottom plan (7) is assembled with the edges of the first, the second, the third and the fourth plans (1,2,5,6), as shown in FIG. 1.

Figure 6:
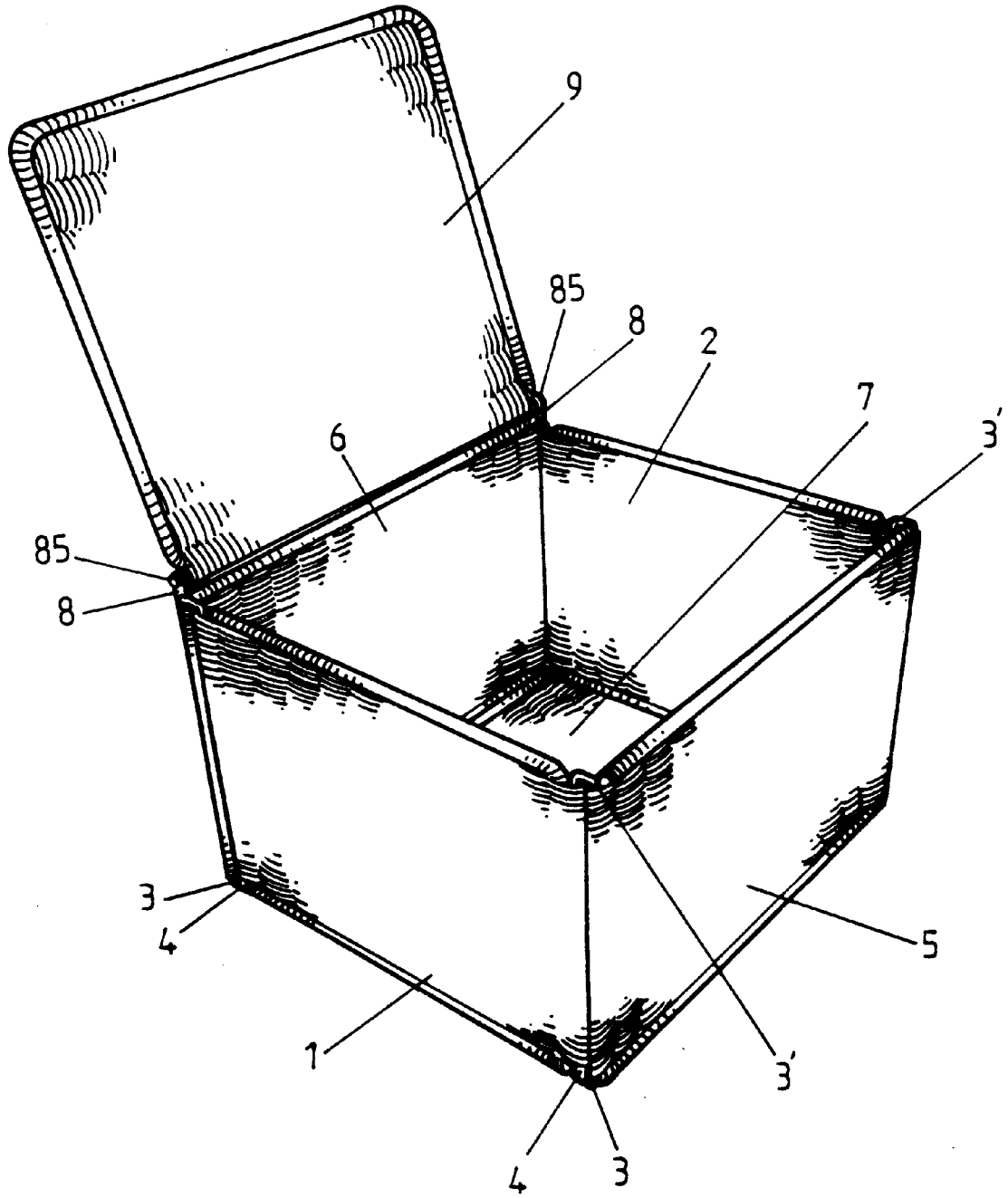
FIG. 6 is a perspective view of an embodiment with a cover pivotally connected with the rattan basket.
Figure 7:
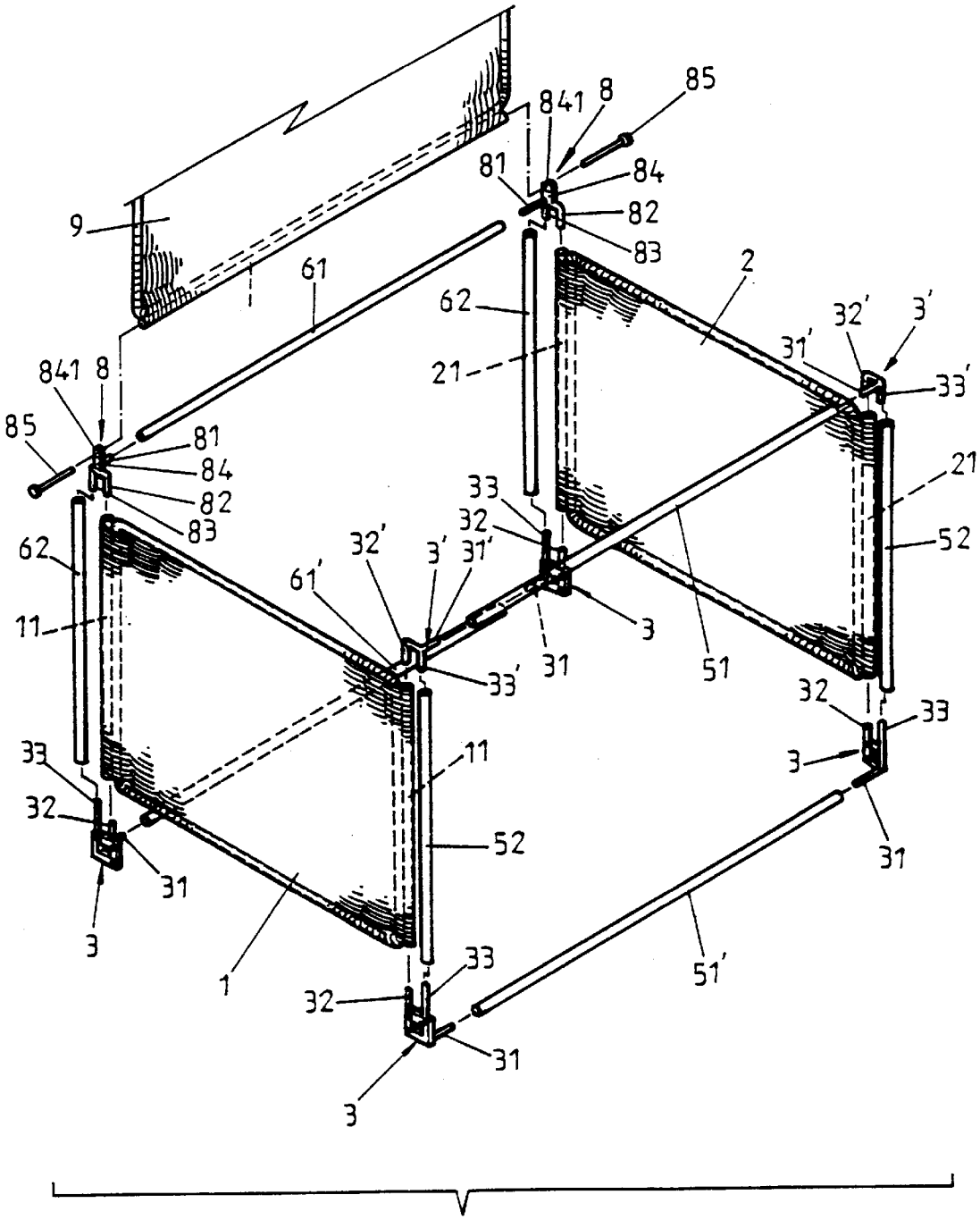
FIG. 7 is an exploded perspective view showing the parts of the rattan basket shown in FIG. 6.

With reference to FIGS. 6 and 7, if a cover (9) having a hollow side frame (91) is about to encase the rattan basket a fourth connector (8) is used to connect the ends of the first, the second and the fourth plans (1,2,6) instead of the second connector (3'). The fourth connector (8) has a first extension (81) integrally extending outward therefrom and corresponding to one distal end of the horizontal frame (51) of the first plan (1) or the horizontal frame (61) of the fourth plan (6) depending on if the edge of the first plan (1) or the fourth plan (6) the cover (9) is to be pivotally connected, two legs (82,83) formed to respectively correspond to one distal end of the vertical rail (61) and the side frame (21) of the second plan (2) and second extension (84) formed upright with respect to the legs (82,83). The second extension (84) has a through hole (841) defined to allow a pin (85) to be inserted therethrough.

Accordingly, when the cover (9) is to be pivotally mounted on top of the rattan basket, the legs (82,83) are respectively inserted into the distal ends of the vertical rail (61) and the side frame (21) and the first extension (81) is inserted into one distal end of the horizontal rail (61) of the fourth plan (6). The pin (85) is then inserted through the through hole (841) of the second extension (84) and into one distal end of the side frame (91) of the cover. Thus, the cover (9) is assembled on the rattan basket so cover the basket.

It is known that from the description above, the present invention has the following advantages:

1. easy to assemble.
2. easy for storage and shipment;
3. reducing cost in both storage and shipment; and
4. adding varieties to the rattan basket.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rattan basket comprising:

a first plan (1), a second plan (2) opposite to the first plan (1), a third plan (5) engaged with edges of the first and the second plans (1,2), a fourth plan (6) engaged with edges of the first and the second plans (1,2) and opposite to the third plan (5) and a bottom plan (7) engaged with edges of the first, the second, the third and the fourth plans (1,2,5,6);

wherein the first plan (1) has a rectangle main frame (10) and two side frames (11) each securely mounted on opposite sides of the main frame (10);

wherein the second plan (2) has a rectangle main frame (20) and two side frames (21) each securely mounted on opposite sides of the main frame (20);

wherein the third and the fourth plans (5,6) respectively have a first and a second spaced horizontal rails (51, 51',61,61') and a pair of spaced vertical rails (52,62);

wherein the side frames (11,21) of the first plan (1) and the second plan (2) are hollow and the first and the horizontal rails (51,51'61,61') are also hollow;

a first connector (3) has a first extension (31) to be inserted into one ends of the horizontal rail (51',61'), a second extension (32) to be inserted into one ends of the side frames (11,21) of the first and the second plans (1,2) and a third extension (33) to be inserted into one ends of the vertical rails (52,62);

a second connector (3') has a first extension (31') to be inserted into the other end of the horizontal rails (51,61), a second extension (32') to be inserted into the other ends of the side frames (52,62) and a third extension (33') to be inserted into the other ends of the vertical rails (52,62); whereby the first connector (3) and the second connector (3') are able to connect the first, the second, the third and the fourth plans (1,2,5,6) together;

wherein the first connector (3) further has a through hole (34) defined therethrough and two horizontal blind holes (35) defined therein;

a bottom plan (7) having two hollow side frames (71) respectively and oppositely mounted on a rectangle main frame (70); and a third connector (4) has a base (41), a extension (42) formed to correspond to the through hole (34) and two horizontal rods (43) formed to correspond to the blind holes (35);

whereby with the insertion of the extension (42) through the through hole (34) and into one distal end of the side frame (71) and the insertion of the horizontal rods (43) into the blind holes (35), the bottom plan (7) is thus secured with respect to the first, the second, the third and the fourth plans (1,2,5,6).

2. A rattan basket comprising:

a first plan (1), a second plan (2) opposite to the first plan (1), a third plan (5) engaged with edges of the first and the second plans (1,2), a fourth plan (6) engaged with edges of the first and the second plans (1,2) and opposite to the third plan (5) and a bottom plan (7) engaged with edges of the first, the second, the third and the fourth plans (1,2,5,6);

wherein the first plan (1) has a rectangle main frame (10) and two side frames (11) each securely mounted on opposite sides of the main frame (10);

wherein the second plan (2) has a rectangle main frame (20) and two side frames (21) each securely mounted on opposite sides of the main frame (20);

wherein the third and the fourth plans (5,6) respectively have a first and a second spaced horizontal rails (51, 51',61,61') and a pair of spaced vertical rails (52,62);

wherein the side frames (11,21) of the first plan (1) and the second plan (2) are hollow and the first and the horizontal rails (51,51'61,61') are also hollow;

a first connector (3) has a first extension (31) to be inserted into one ends of the horizontal rail (51',61'), a second extension (32) to be inserted into one ends of the side frames (11,21) of the first and the second plans (1,2) and a third extension (33) to be inserted into one ends of the vertical rails (52,62);

wherein the first connector (3) further has a through hole (34) defined therethrough and two horizontal blind holes (35) defined therein;

a bottom plan (7) having two hollow side frames (71) respectively and oppositely mounted on a rectangle main frame (70); and a third connector (4) has a base (41), a extension (42) formed to correspond to the through hole (34) and two horizontal rods (43) formed to correspond to the blind holes (35);

whereby with the insertion of the extension (42) through the through hole (34) and into one distal end of the side frame (71) and the insertion of the horizontal rods (43) into the blind holes (35), the bottom plan (7) is thus secured with respect to the first, the second, the third and the fourth plans (1,2,5,6);

a fourth connector (8) has a first extension (81) integrally extending outward therefrom and corresponding to one distal end of the horizontal frame (61) of the fourth plan (6), two legs (82,83) formed to respectively correspond to one distal end of the vertical rail (61) and the side frame (21) of the second plan (2) and a second extension (84) formed upright with respect to the legs (82,83);

wherein the second extension (84) has a through hole (841) defined to allow a pin (85) to be inserted therethrough; whereby a cover (9) having two opposite hollow side frames are able to be pivotally connected to an edge of the fourth plan (6).

* * * * *